US006260704B1

(12) United States Patent
Jansen et al.

(10) Patent No.: US 6,260,704 B1
(45) Date of Patent: Jul. 17, 2001

(54) BAND TOTE ASSEMBLY

(75) Inventors: George A. Jansen, Denver; Thomas M. Rotar, Thornton, both of CO (US)

(73) Assignee: Band-It-IDEX, Inc., Denver, CO (US)

( * ) Notice: Subject to any disclaimer, the term of this patent is extended or adjusted under 35 U.S.C. 154(b) by 0 days.

(21) Appl. No.: 09/312,805

(22) Filed: May 17, 1999

(51) Int. Cl.[7] ..... B65D 85/675

(52) U.S. Cl. ..... 206/403; 206/389; 206/409; 206/226

(58) Field of Search ..... 206/226, 303, 206/403, 404, 405, 409, 389; 220/4.21, 4.24

(56) References Cited

U.S. PATENT DOCUMENTS 3,087,608 * 4/1963 Craven .
3,260,360 * 7/1966 Davis .
3,552,551 * 1/1971 Goldberg .
3,568,947 * 3/1971 Oprins .
4,475,652 10/1984 Heard ..... 206/409
4,905,822 * 3/1990 Bosco ..... 220/4.24
5,692,700 * 12/1997 Bobeczko .

* cited by examiner

*Primary Examiner*—David T. Fidei
(74) *Attorney, Agent, or Firm*—Sheridan Ross, P.C.

(57) ABSTRACT

A tote assembly to package, store, carry and/or dispense a length of flexible banding material coiled therein is provided. The tote assembly is fabricated from at least two pieces, of the same or different width, that are connected to form a cavity to house a banding material having a defined width. The tote assembly may be connected by one or more post and receptacle connectors and multiple tote assemblies may be stacked by a dimple and depression arrangement. The tote assembly further may include a removable buckle container and a removable cutting tool. Also provided is a method of inserting the banding material directly into a closed tote assembly through a band opening and winding the banding material therewithin.

13 Claims, 17 Drawing Sheets

BAND TOTE ASSEMBLY

FIELD OF INVENTION

This invention generally relates to tote assemblies used to house banding material and, more particularly, to tote assemblies fabricated from at least two pieces, having interior walls of the same or different height, that are connected to package, store, carry or dispense flexible banding material coiled therein.

BACKGROUND OF THE INVENTION

Band clamps are widely used in a variety of applications. The clamps generally include a flexible band that can be formed into a loop around an object, such as a telephone pole or signage pole, and a separate buckle that receives the opposing ends of the band and locks the ends in a fixed position. An example of a non-performed band clamp that is useful for outdoor applications is described in U.S. Pat. No. 4,765,032. Generally, banding material is manufactured in lengths of up to about one hundred feet or more, wound into circular coils for storage and transportation, and later partially unwound to cut off a desired length of band, as needed.

Various types of containers have been used to package, store, carry and dispense coils of flexible band. The band typically is wound into a spiral coil, before being placed into an open container. The open container receives the band and then is closed with a second piece, such as a lid. As such, prior containers require at least some assembly after the banding material is inserted. This can be cumbersome and expensive, often requiring significant manual assembly, in part due to the weight and the pressure of the coiled, flexible band against the container.

Containers are constructed in a variety of sizes to accommodate banding material of a variety of widths and lengths. Bands for these applications typically are manufactured in widths varying from about less than ¼ inch to a little over one inch and in lengths varying from several feet to several hundred feet. To securely hold the coiled banding material, the container must have side walls of sufficient height to house the banding material, without allowing it to partially or completely unwind. As such, such containers typically are constructed of two pieces to provide the desired side wall height for each different width of banding material, either 1) one piece having a side wall to accommodate the desired width of banding material and a second piece essentially being a lid, without a sidewall; or 2) two pieces having sidewalls of substantially the same height to combine to provide the desired height. In either event, a large number of separate pieces are required to construct such containers to accommodate a variety of widths of banding material.

Accordingly, it would be desirable to provide a tote assembly that incorporates additional advantages associated with assembling, packaging, storing, carrying and/or dispensing coiled, flexible banding material.

SUMMARY OF THE INVENTION

The present invention is directed to a band carrying device that includes a first tote assembly with a first tote member of a first width and a second tote member of the same or a second width, which is different from the first width, and a band held within the tote members. The first and second tote members may be connected by inserting at least one post on the periphery from one tote member into a corresponding receptacle of the other tote member.

A further embodiment of the invention is directed to a band carrying device that includes first and second tote assemblies, each with two tote members of the same or different widths, and a band held within the each tote assembly. The first and second tote assemblies may be stacked together by inserting at least one dimple of one tote member into a corresponding receptacle of the other tote member.

Yet another embodiment of the invention is directed to a method for assembling a band carrying device comprising inserting a tote assembly into a winding machine, locating a band through a band opening of the tote assembly, winding the band about a hub of the winding machine and removing the tote assembly from the winding machine. The band carrying device also may be provided with a band cutting insert tool and or may be printed with identifying indicia on a flat top surface.

Other objects and advantages of the invention will become apparent on reading the following detailed description and the appended claims, and also by referring to the accompanying drawings.

BRIEF DESCRIPTION OF THE DRAWINGS

FIGS. 18A–18F illustrate diagrammatically steps of winding a band inside a tote assembly using the band winder;

DETAILED DESCRIPTION

The relationship and workings of the various elements of the invention will be better understood by the following detailed description. However, the embodiments of the invention described below are by way of example only and the invention is not limited to the embodiments described. Furthermore, one should understand that the drawings are not to scale and that the embodiments are illustrated by graphic symbols and fragmentary views. In certain instances, details may have been omitted that are not necessary for an understanding of the present invention, such as conventional details of fabrication and assembly.

Figure 1:
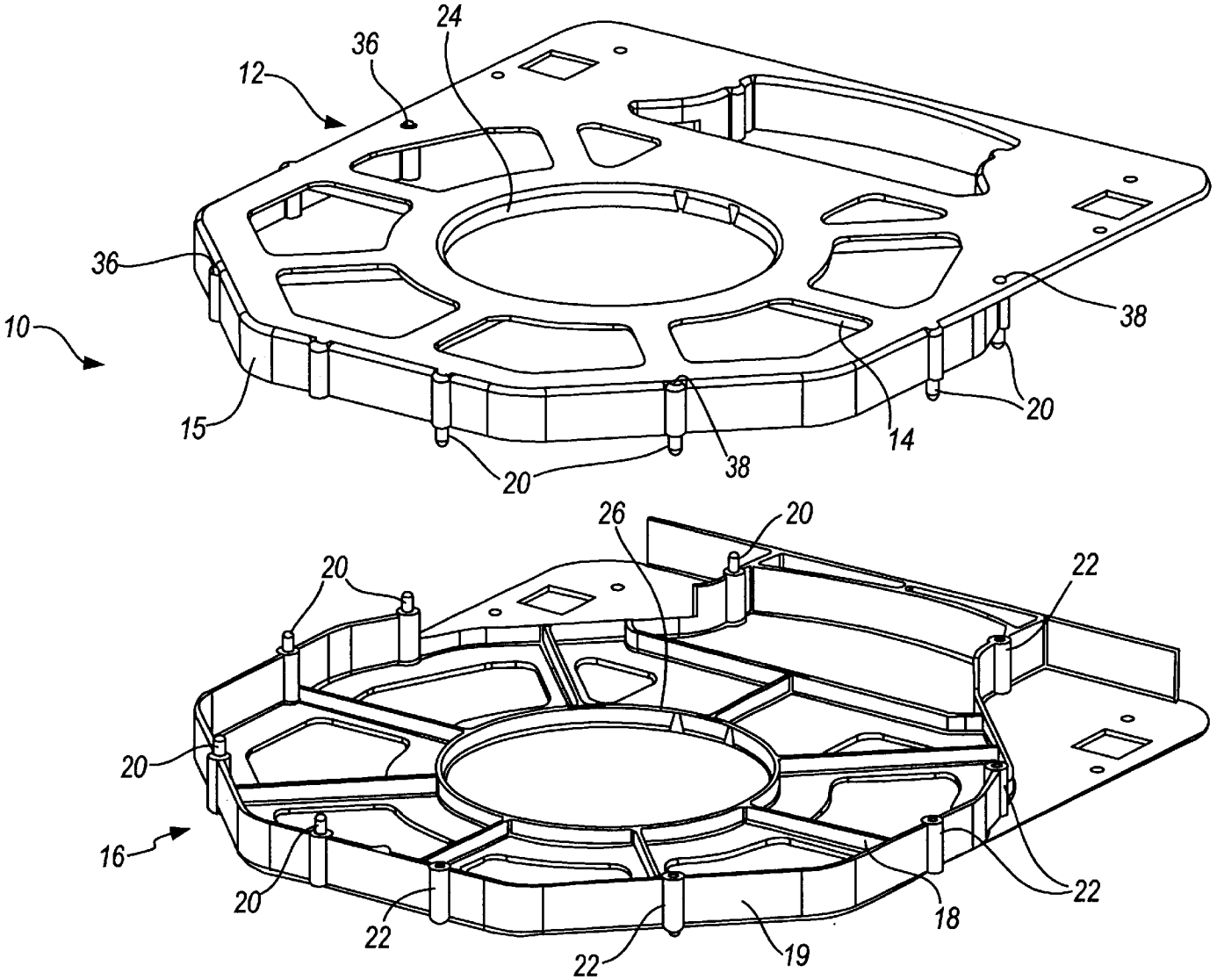
FIG. 1 is an exploded view of a tote assembly having a first tote member and a second tote member, without a band installed.

Referring to FIG. 1, one embodiment of the tote assembly 22 of the present invention is shown in an exploded view, without a band. A first tote member 12 comprises one or more posts 20 located around its periphery and a second tote member 14 comprises one or more corresponding receptacles 22 located around its periphery. Preferably, the first tote member 12 and the second tote member each contain at least one post 20 and at least one receptacle 22. Most preferably, the first tote member 12 comprises about five posts 20 located around the periphery of the right half of the first tote member 12 and about five receptacles 22 located around the periphery of the left half of the first tote member 12. Correspondingly, the second tote member 16 most preferably comprises about five receptacles 22 located around the periphery of the right half of the second tote member 16 and about five posts 20 located around the periphery of the left half of the second tote member 16. To assemble the tote assembly 22, a post 20 of one tote member is lined up with and inserted into the corresponding receptacle 22 of the other tote member. Preferably, the post 20 and receptacle 22 are fabricated of resilient material, such as molded plastic, to provide a snap fit connection, although various other common connecting mechanism or ways could be employed.

Figure 2:
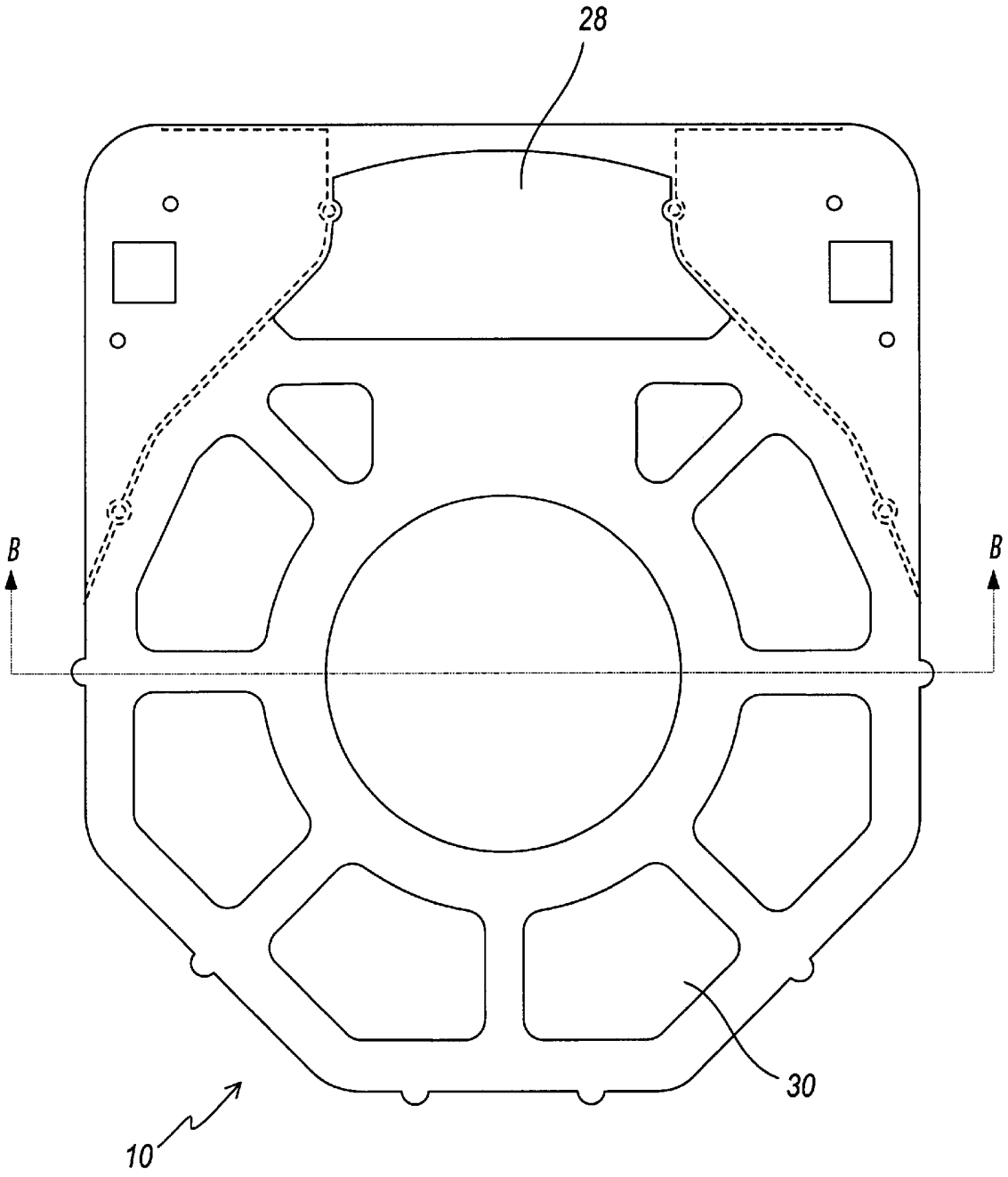
FIG. 2 is a front plan view of a tote assembly, without a band installed.

The tote assembly 10 is shaped and sized to coaxially receive a coil of flexible band, which typically is wound into a spiral. Referring to FIGS. 1–2, the tote assembly 10 preferably is generally polygonal, with a generally octagonal shaped interior to house a spiral coil of flexible band 32. The tote assembly 10 comprises an access window 28 that provides an opening to manually access the band 32. For example, one may reach through the access window 28 to the interior of the tote assembly 10 and advance or retract the band 32 from its coiled state. When a strip of the band 32 is cut off for use, the remaining portion of the band 32 typically extends through the band opening 34. The ability to manually retract the end of the band 32 back into the interior of the tote assembly 10 protects the band 32 from damage and protects the user from injury. Also, the access window 28 provides an opening to hold and carry the tote assembly 10. Additional windows 30 may also be provided for a visual determination of the amount of band remaining in the tote assembly 10 and to reduce its cost and weight.

Figure 3:
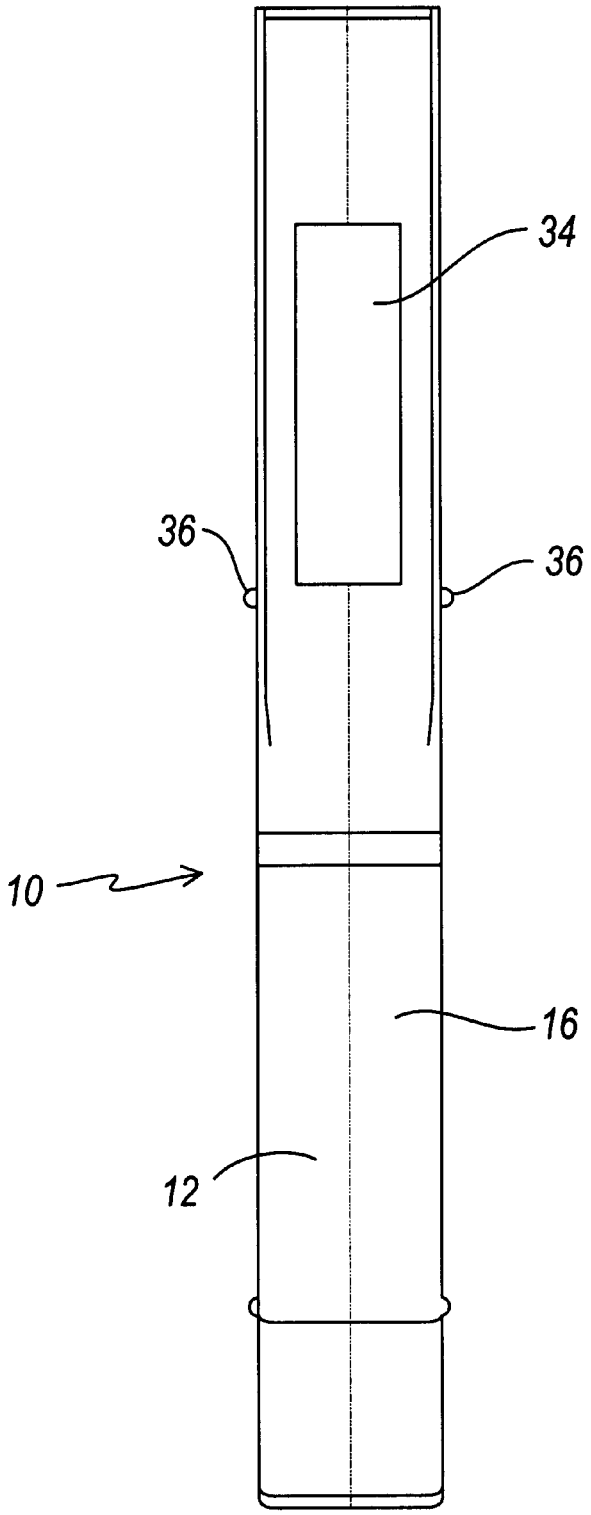
FIG. 3 is a right side view of a tote assembly, without a band installed.

Referring to FIG. 3, a right side view of the tote assembly 10 is shown in FIGS. 1–2. The first tote member 12 and the second tote member 16 are connected to define a band opening 34. The band opening 34 provides access to insert the band, as described in more detail below, and also provides an opening to selectively remove all or part of the band 32, as desired in use. Also, to provide greater flexibility in inserting and removing the band 32, as well as to reduce cost and weight, preferably both the right side and the left side of the tote assembly 10 have such a band opening 34.

To securely hold the coiled, flexible band 32, the tote assembly 10 must have a width sufficient to house the band 32, without allowing it to partially or completely unwind. The tote assembly 10 provides a cavity that is greater than the width of the band 32 desired to be housed therein. Because the band 32 can be commercially available in various widths, it is preferred that a tote assembly 10 be available for each available width of band 32.

To provide flexibility in manufacturing a tote assembly 10 to accommodate a desired width of band 32, the first tote member 12 has a first interior spoke 14 and the second tote 16 has a second interior spoke 18. The first interior spoke 14 and the second interior spoke 18 may be of the same or different dimensions to create a tote assembly 10 having a cavity of a desired width for a particular width of band 32. Generally, a shorter interior spoke 14 or 18 will result in a larger cavity to house a larger width band 32, while a taller spoke 14 or 18 will result in a smaller cavity to house a smaller width band 32. For example, the first interior spoke 14 may be ¼ inch high and the second interior spoke may be 7⁄16 inch high to create a tote assembly 10 having a interior width of about 11⁄16 inch to house a band about ½ inch wide.

Referring again to FIG. 1, preferably the first tote member 12 comprises a circular rib 24 and the second tote member 16 comprises a circular rib 26, each positioned at approximately the center of the tote assembly 10. The circular ribs 24, 26 have the same diameter, which is sufficient to house the mandrel of the winding machine and allow its operation, as described below. Also, the circular ribs 24, 26 provide a rigid opening for the mandrel. Preferably, the diameter of the circular ribs 24, 26 is about four and one-half inches.

The first tote member 12 also comprises a series of interior spokes 14 emanating from the circular rib 24 to the exterior side wall 15. Similarly, the second tote member 16 comprises a series of interior spokes 18 emanating from the circular rib 26 to the exterior side wall 19. Preferably, the height of the circular ribs 24 of the first tote member 12 is about the same as the height of the interior spoke 14, while the height of the circular ribs 26 of the second member 16 is about the same as the height of the interior spoke 18. When the first tote member 12 and the second tote member 16 are connected, the combined height of the interior spokes 14, 18 defines the cavity in which the band is housed. By keeping the dimensions of the exterior side walls 15, 19 constant, the width of the cavity housing the band then may be selected by selecting the appropriate height of the interior spokes 14, 18.

Figure 4:
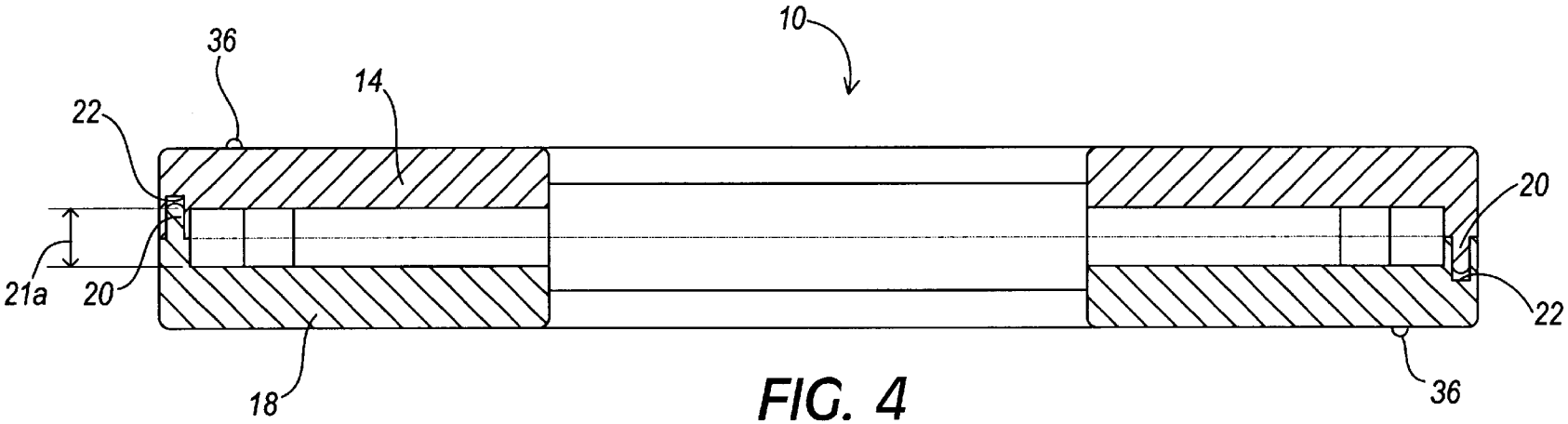
FIG. 4 is a cross sectional view of a tote assembly, with the interior spoke of the first tote member having a first height and the interior spoke of the second tote member having the same first height.
Figure 5:
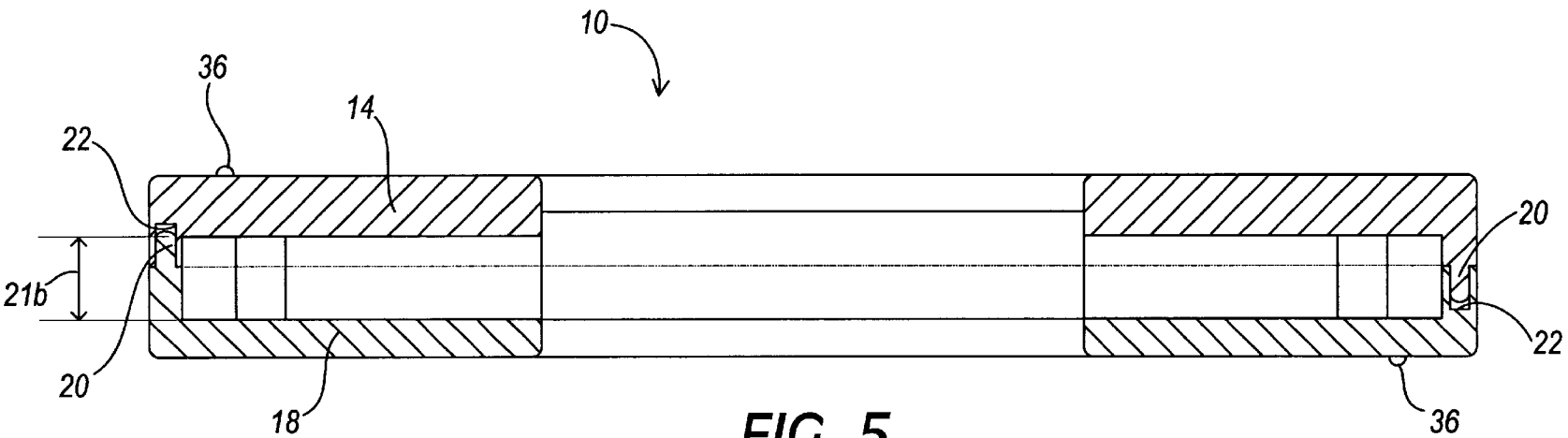
FIG. 5 is a cross sectional view of a tote assembly, with the interior spoke of the first tote member having a first height and the interior spoke of the second tote member having a second height.
Figure 6:
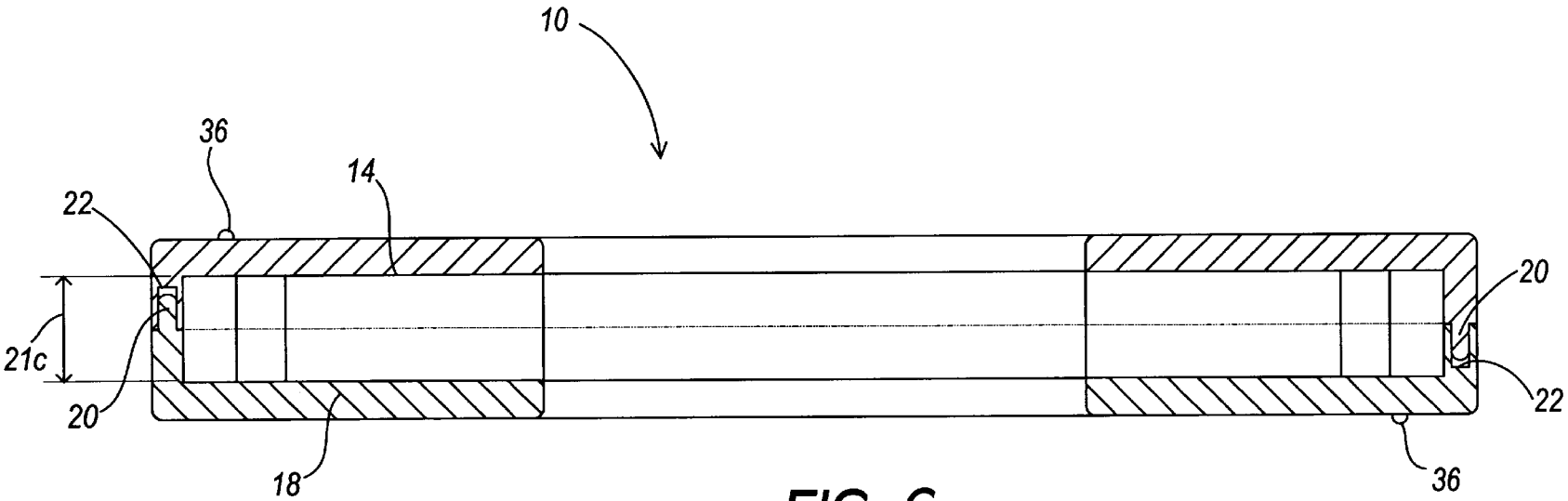
FIG. 6 is a cross sectional view of a tote assembly, with the interior spoke of the first tote member having a second height and the interior spoke of the second tote member having the same second height.
Figure 7:
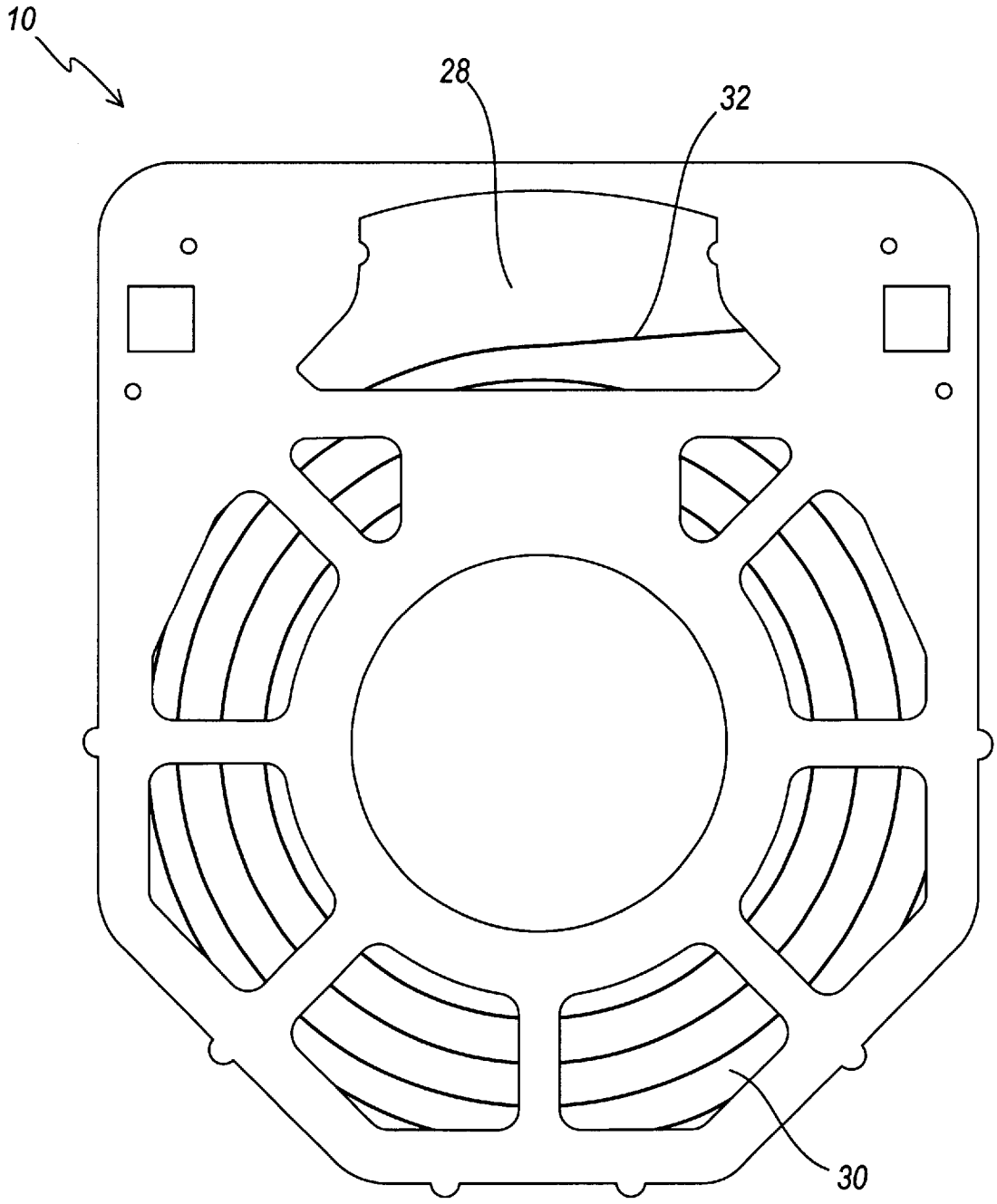
FIG. 7 is a front plan view of a tote assembly, with a roll of band installed.

More particularly, and as shown in more detail in FIGS. 4–6, a tote assembly 10 comprises a first tote member 12 and a second tote member 16 that are snapped together by inserting posts 20 into corresponding receptacles 22. The first tote member 12 and second tote member 16 combine to define a cavity 21 to house the band. As shown in FIG. 4, the height of the first interior spoke 14 and of the second interior spoke 18 are about the same and combine to define the cavity 21A. As shown in FIG. 5, the height of interior spoke 14 remains the same as in FIG.4, but a shorter height of interior spoke 18 results in a larger cavity 21B, to house a wider band. Finally, as shown in FIG. 6, the shorter height of both interior spokes 14, 18 results in an even larger cavity 21C, to house an even wider band. Meanwhile, in each of the examples shown in FIGS. 4–6, the outside width of the tote assembly 10 remains the same.

Figure 8:
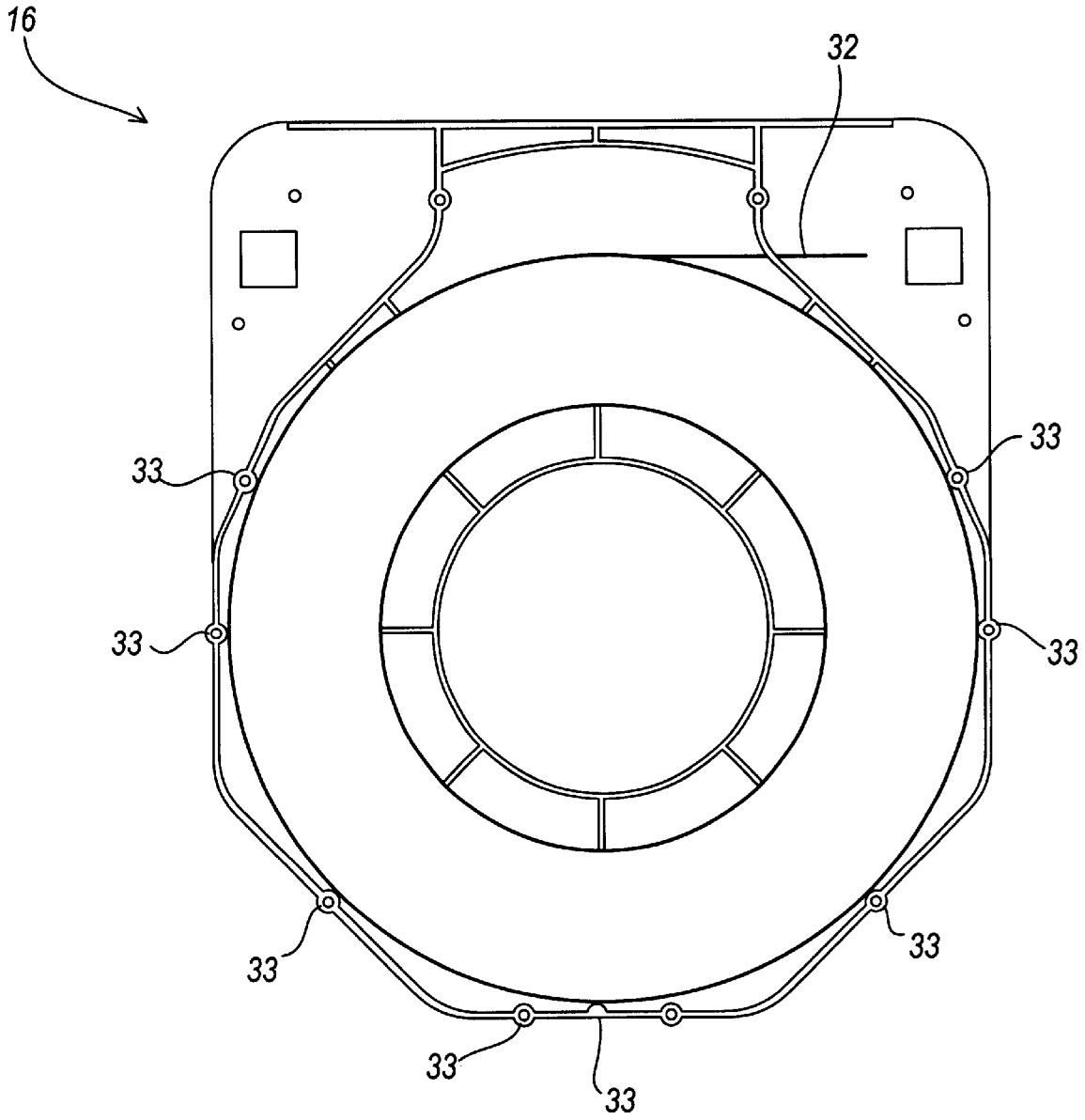
FIG. 8 is a front plan view of a tote assembly, with the first tote member removed to show roll of a band installed in the second tote member.

Referring now to FIG. 8, the second tote member 16 is shown with the first tote member 12 removed to show a band 32 installed therein. Contact nubs 33 are provided at selected intervals around the periphery of the interior of the second tote member 16. Preferably, the contact nubs 33 are positioned at approximately the midpoint of each straight side of the generally polygonal shaped interior surface of the second tote member 16. The contact nubs 33 provide selected points of contact between the coiled band 32 and the second tote member 15. The pressure exerted by the coiled band 32 against the interior of the tote member 12 is thereby directed primarily to the contact nubs 33, which are preferably cylindrical to present a rounded surface to the coiled band 32. The contact nubs 33 facilitate the retrieving and removal of the band 32, while reducing the likelihood and severity of the coiled band 32 binding on the interior of the second tote member 16. Preferably, the first tote member 12 comprises similar contact nubs 33.

Figure 10:
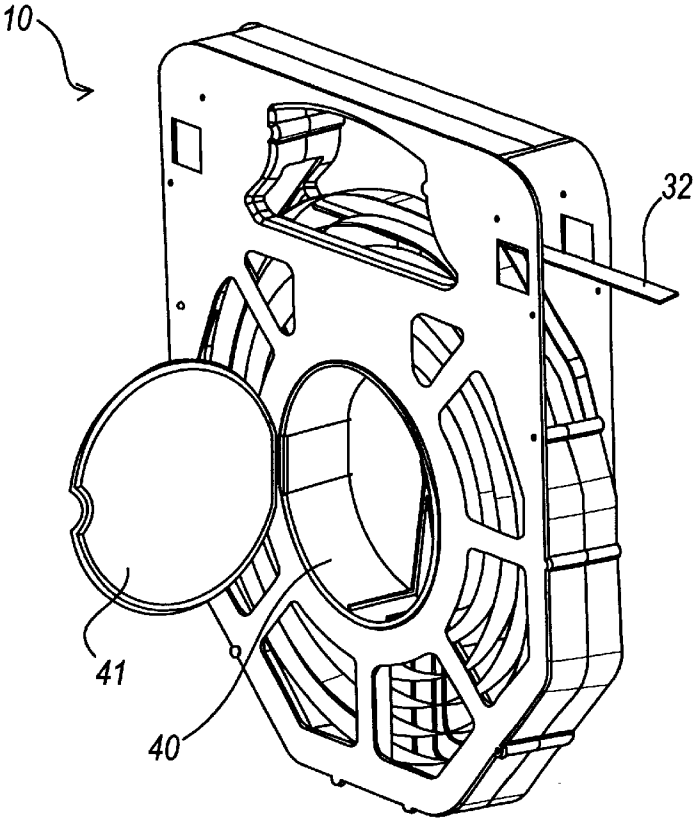
FIG. 10 is a perspective view of a tote assembly, with a band installed and with a buckle container installed.
Figure 9:
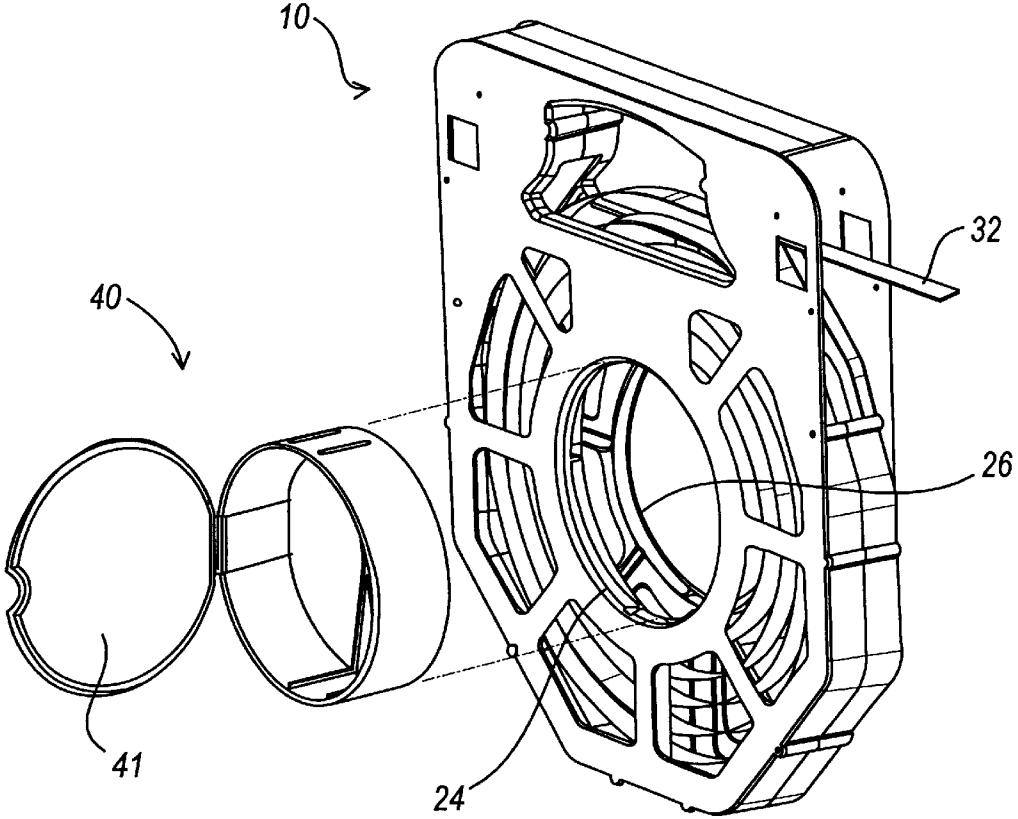
FIG. 9 is a exploded view of a tote assembly, with a band installed and with a buckle container.

As shown in FIGS. 9–10, a buckle container 40 may be provided for insertion into the central opening formed by the circular ribs 24, 26. Preferably, the buckle container 40 is formed of resilient material, such as plastic, to allow a snap fit with the circular ribs 24, 26. In use, a portion of the band 32 is drawn out of the tote assembly 10 and cut to a strip of a desired length. The strip of cut band 32 is typically wound about an object and then secured by a separate buckle. These buckles are needed with each application of a band and have relatively short dimensions. Buckle container 40 houses a supply of buckles, preferably at least one for each length of band 32 contained within the tote assembly 10. A closable lid 41 keeps the buckles secure, while allowing ready access when desired.

Figure 11:
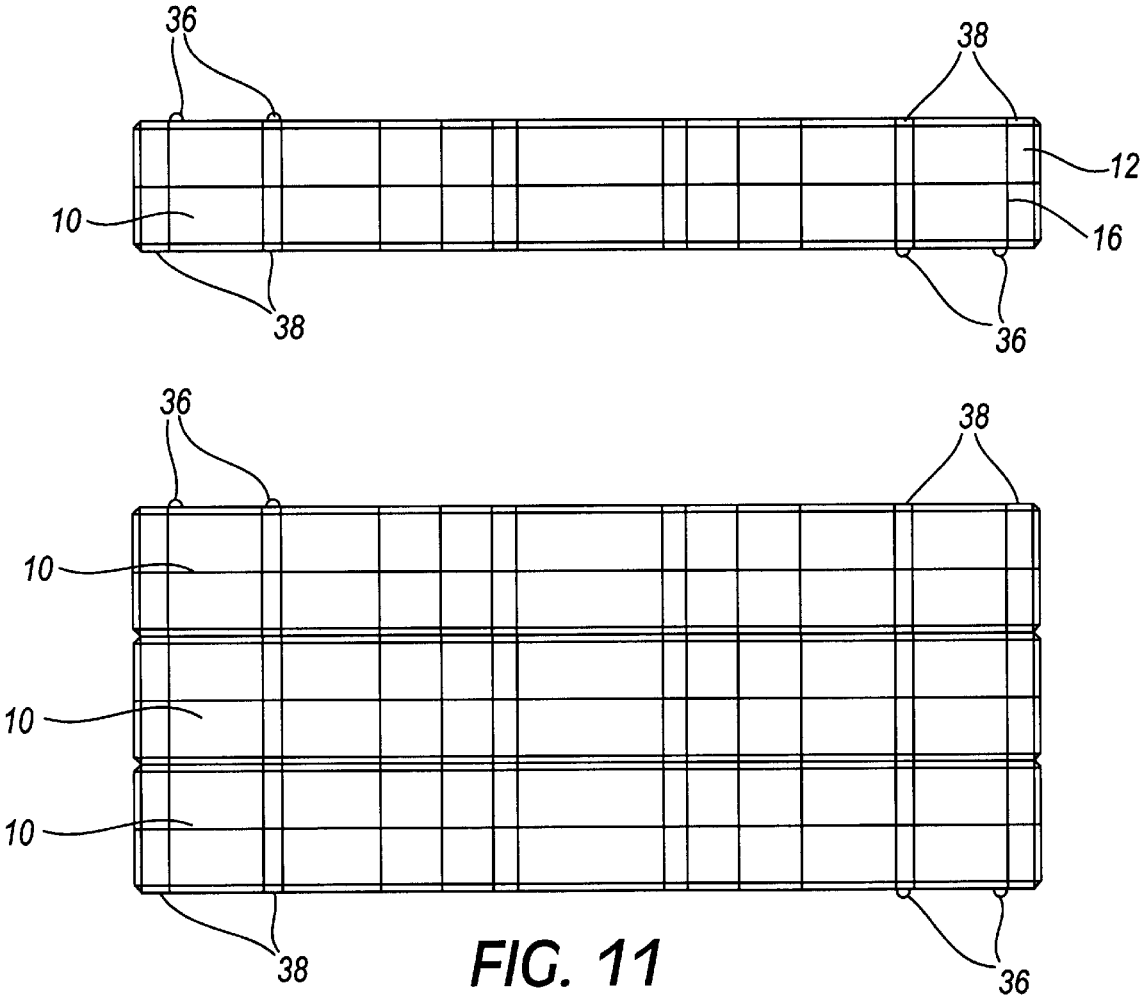
FIG. 11 is a bottom plan view of four tote assemblies, three of which are stacked together.
Figure 17:
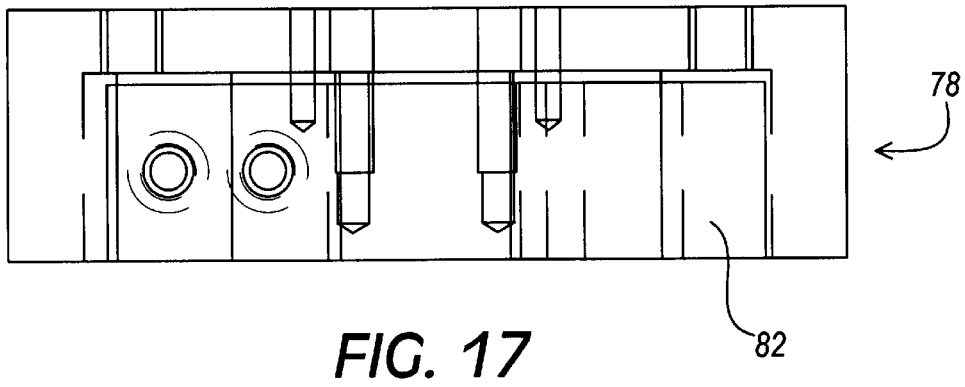
FIG. 17 is a top plan view of the band winder shown in FIG. 16.
Figure 12:
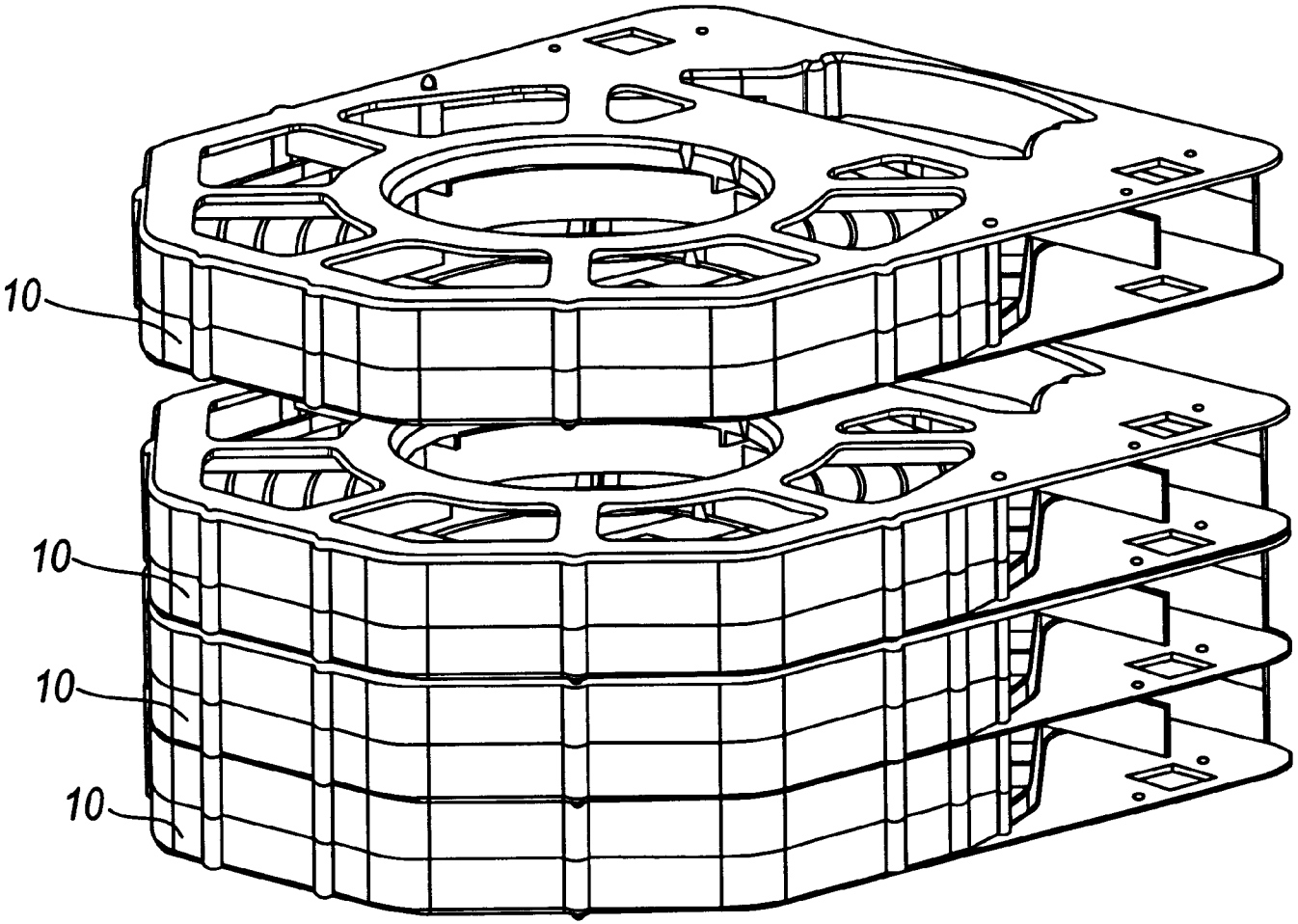
FIG. 12 is a exploded view of four tote assemblies, three of which are stacked together.

It may be desirable to stack two or more tote assemblies 10 for shipping, storage or the like. As shown in FIGS. and 11, to facilitate such stacking, a tote assembly 10 may comprise one or more dimples 36 and depressions 38, which match with corresponding depressions 38 and dimples 36 of a second tote assembly 10. Preferably, the first tote member 12 and the second tote member 16 each comprise two dimples 36 spaced apart on one side of the front outside surface of the first tote member 12 and two depressions 38 spaced apart on the other side of the front outside surface of the first tote member 12. As shown in FIG. 11, when the first tote member 12 and the second tote member 16 are connected, the two dimples 36 of the first tote member 12 are located directly in line with the two depressions 38 of the second tote member 16. Similarly, the two dimples 36 of the second tote assembly 16 are located directly in line with the two depressions 38 of the first tote assembly 12. In this fashion, two or more tote assemblies 10 may be stacked, as shown in FIGS. 11–12.

Figure 13:
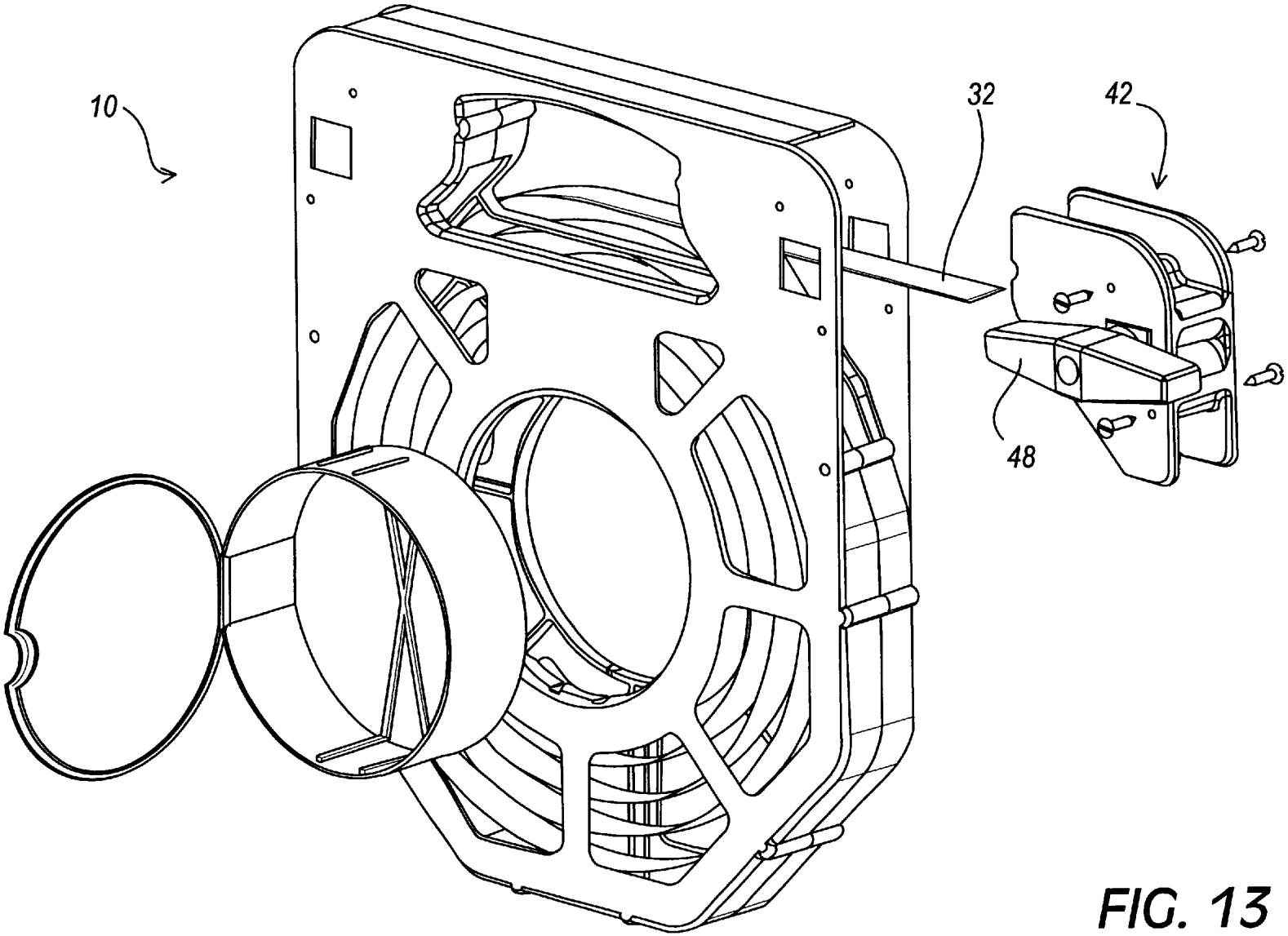
FIG. 13 is a exploded view of a tote assembly, with a band installed and with a buckle container and an insert cutting tool.
Figure 14:
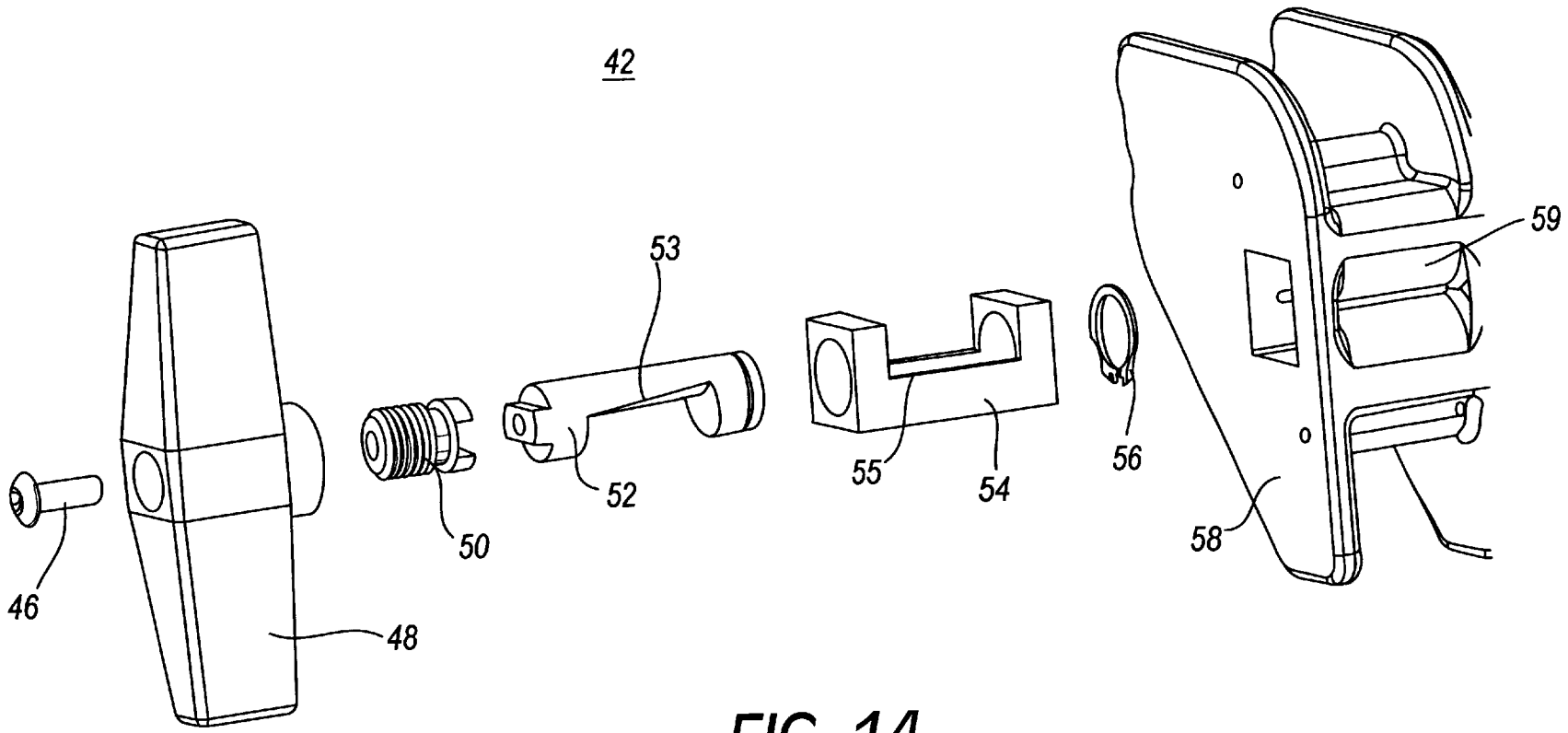
FIG. 14 is a exploded view of an insert cutting tool.
Figure 15:
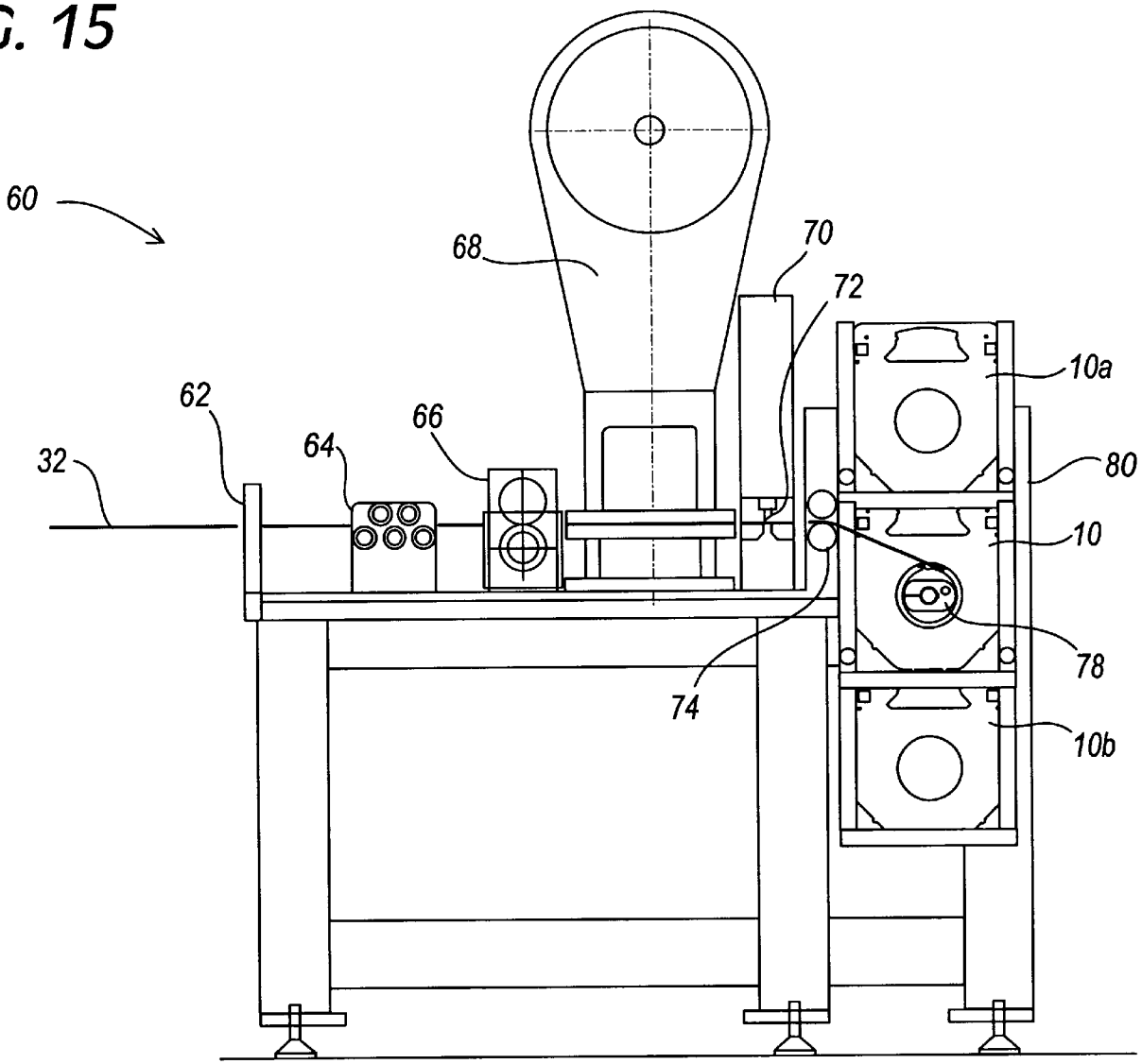
FIG. 15 is a front plan view of a winding machine.
Figure 16:
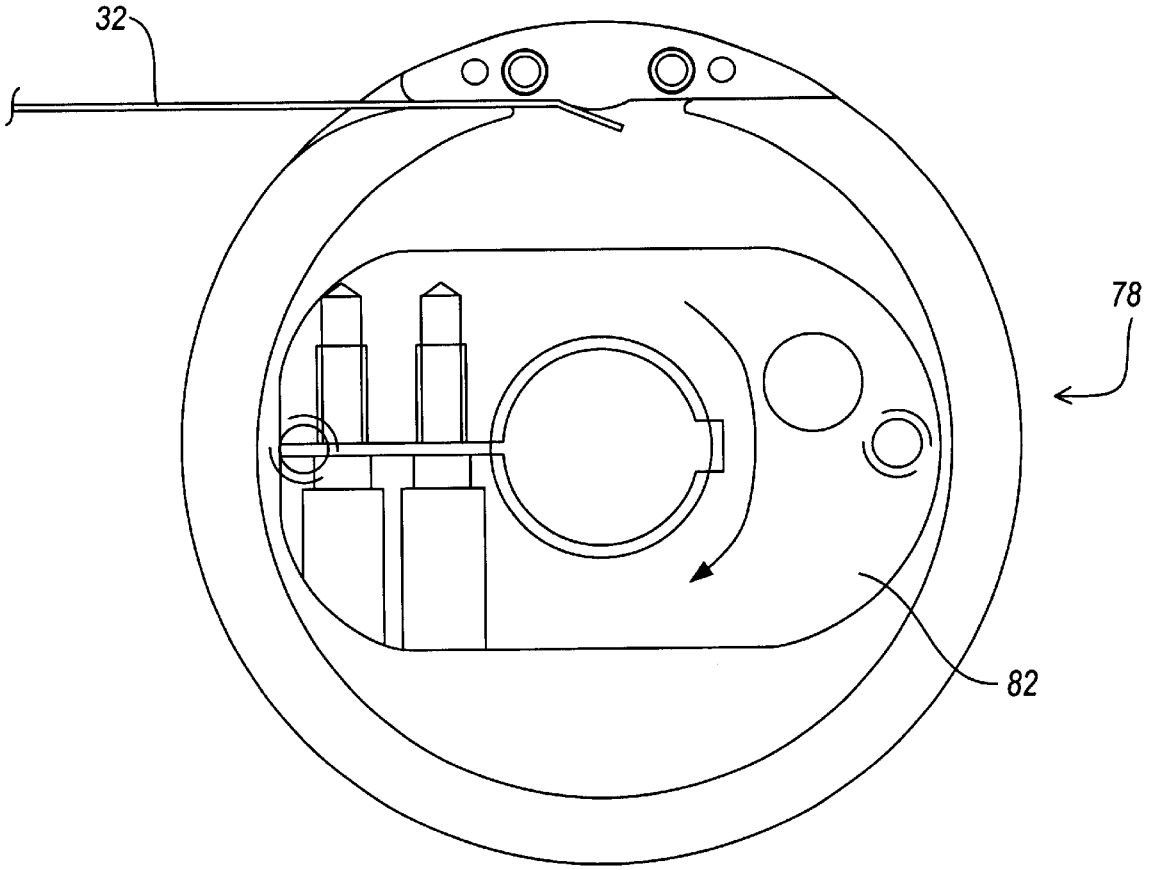
FIG. 16 is a front plan view of the band winder component of a winding machine, showing a band entering the band winder and the direction of travel of the band and the band winder.
Figure 18A:
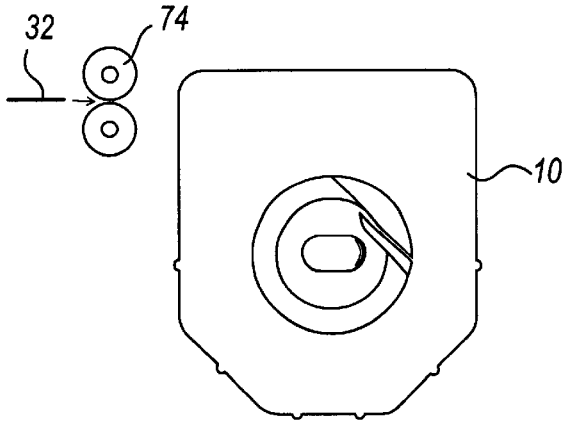
Figure 18B:
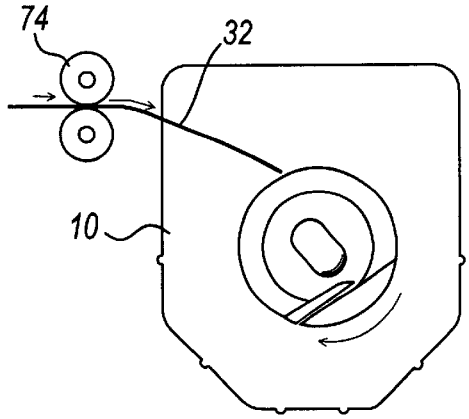
Figure 18C:
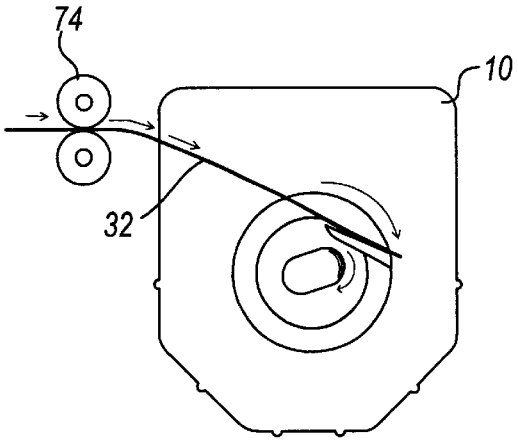
Figure 18D:
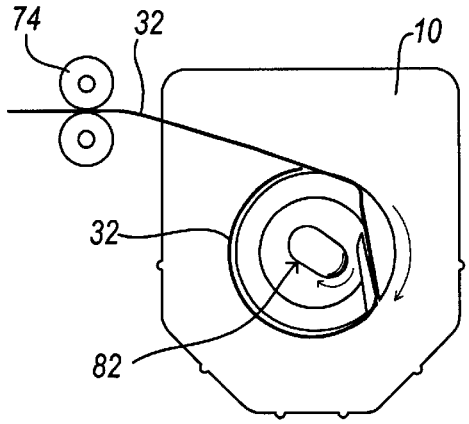
Figure 18D:
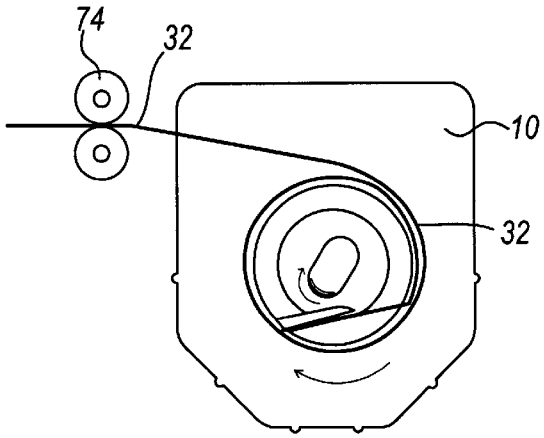
Figure 18E:
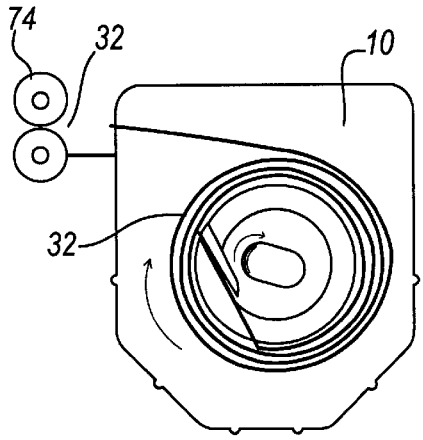
Figure 19:
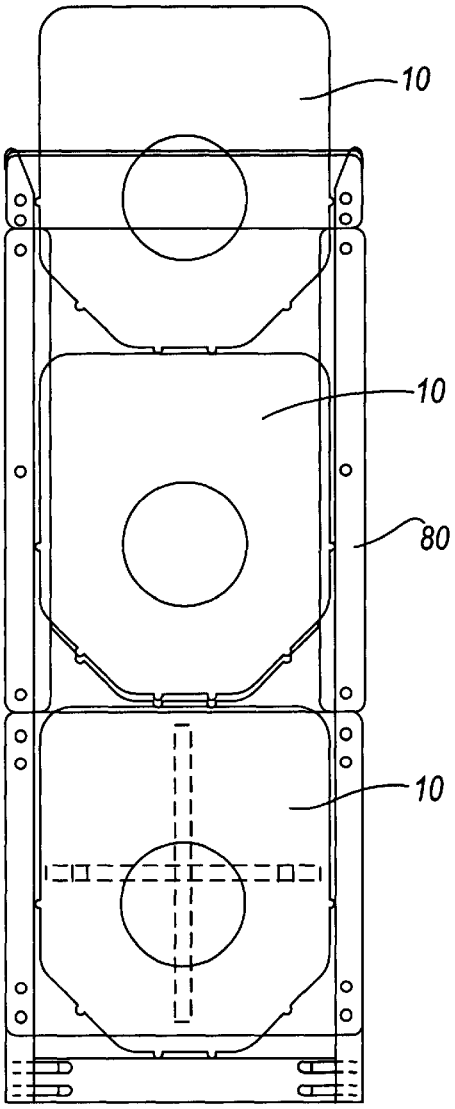
FIG. 19 is a front plan view of a vertical tote assembly feed of a winding machine, showing three tote assemblies.
Figure 20:
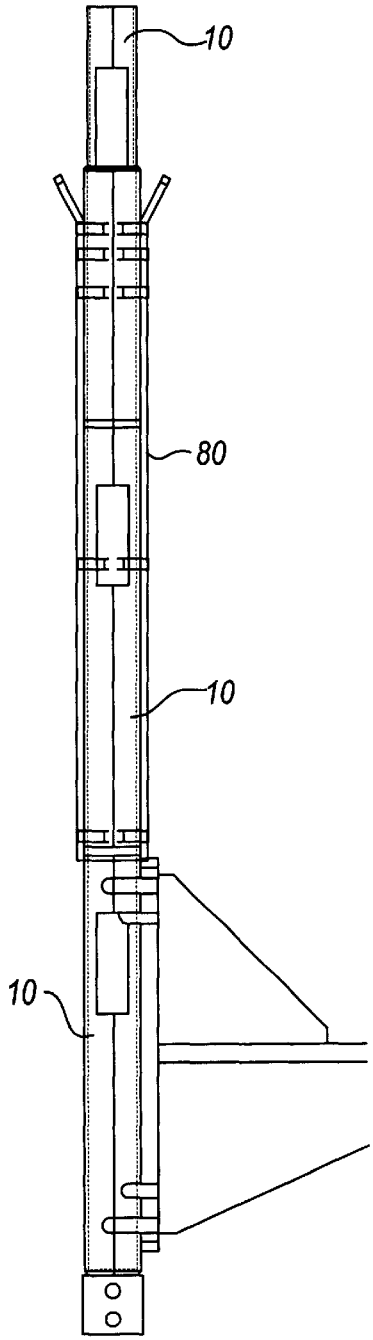
FIG. 20 is a right side plan view of the vertical tote assembly feed shown in FIG. 19.
Figure 21:
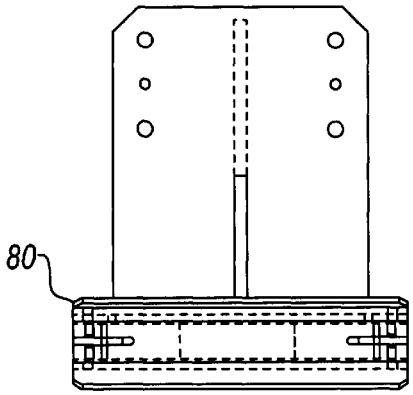
FIG. 21 is a top plan view of the vertical tote assembly feed shown in FIG. 19.

Referring to FIGS. 13–14, the tote assembly 10 may further comprise an insert cutting tool 42 to cut off a desired length of band 32. The insert cutting tool 42 preferably is connected with assembly screws 44 to the tote assembly 10 near the band opening 34. The insert cutting tool 42 preferably comprises a screw 46 connecting a knob 48 to a threaded insert key 50, which in turn is connected to a cutter bar 52 with a cutting edge 53, a cutter block insert 54 with a cutting edge 55, a retaining ring 56 and a cutter head 58.

Figure 22:
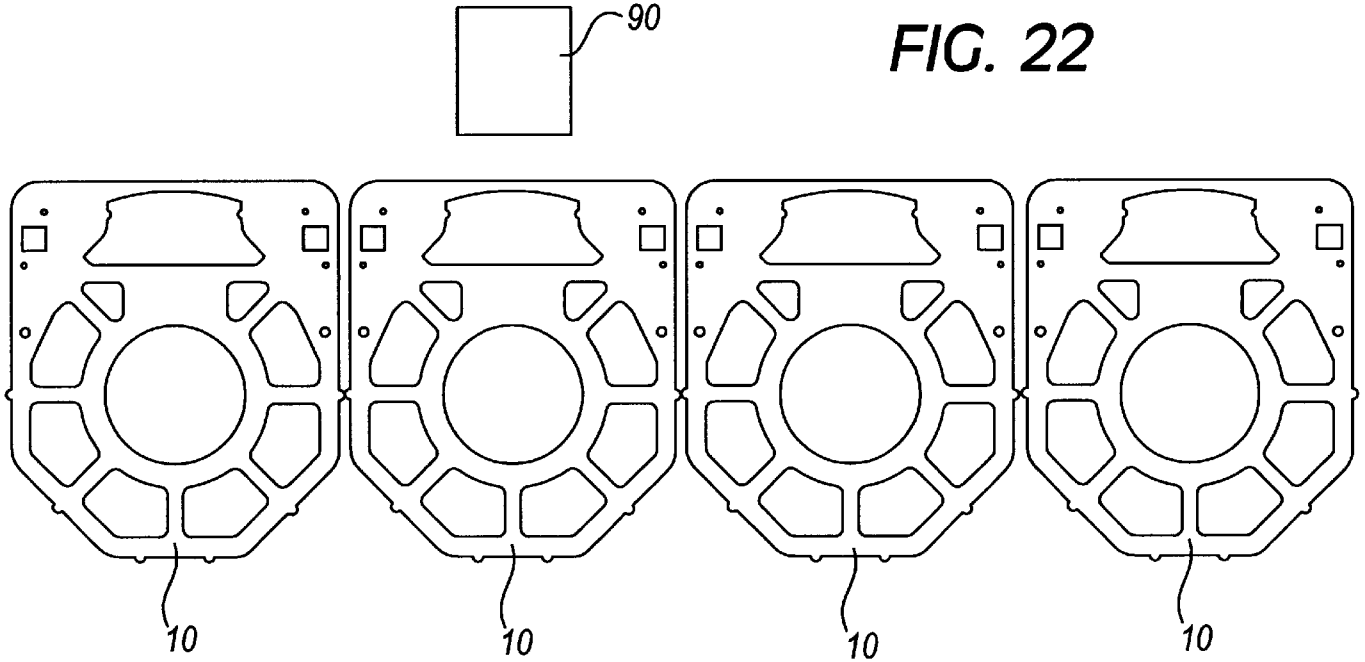
FIG. 22 is a front plan view of four tote assemblies in an assembly line, one of which is opposing a printer.
Figure 23:
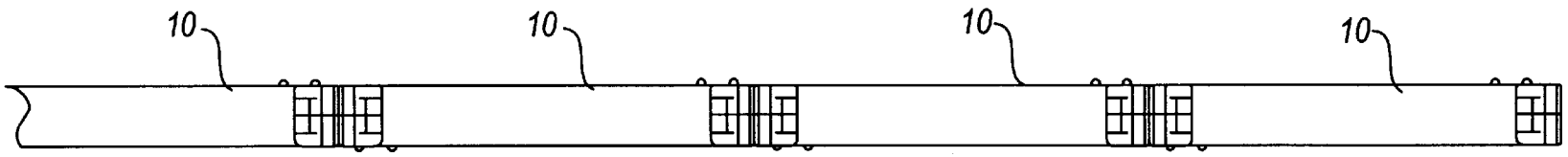
FIG. 23 is a top plan view of four tote assemblies in an assembly line, two of which show printed text, with an exploded view of such printed text.

As shown in FIGS. 22–23, the tote assembly 10 comprises a top surface that is flat for at least a portion thereof to allow the printing or other marking of indicia, such as the size, length and manufacturer of the band contained within the tote assembly 10. Because this indicia is located on the top surface, it may be seen even when the tote assemblies 10 are stacked.

Now referring to FIGS. 15–21, an apparatus for and method of inserting a length of band into a tote assembly are illustrated. A winding machine 60 comprises a band inlet guide 62, straightening rolls 64, a niproll 66, a punch press 68, a band cutter 70 with a band cutter blade 72, a band bender 74 and a band winder 78. A supply of band 32 is provided, which typically is in the form of coiled lengths of at least about 500 feet of band that are unwound with an unwind reel (not shown). A roll edger is used to round the edges of the band 32 (not shown). One end of the band 32 is then fed into the band inlet guide 32, which includes a slot to direct the band 32 to the straightening rolls 64 to straighten or flatten the band 32. The end of the band 32 is then fed into a niproll 66, which uses a servo motor to feed the band forward into the winding machine 60 and which accurately measures the band as it passes through to the optional punch press 68. The band bender 74 bends the band 32 to enter the band winder 78 at the appropriate angle. The band winder 78 winds the band 32 within the closed, assembled tote assembly 10. The band cutter blade 72 of the band cutter 70 cuts off the band when the desired length of band has been inserted into the tote assembly 10, typically about one hundred feet.

As shown in FIGS. 15, 16, 17 and 18A–18F, a tote assembly 10 is inserted into a tote assembly support 80 for insertion of the band 32. A mandrel 82 is pushed into the center opening of the tote assembly 10. The mandrel 82 comprises a mechanism, such as a hook and dog, to secure the end of the band 32, which has been either manually or automatically fed through the band opening 34 of the tote assembly 10 into the band winder 78. As shown in FIGS. 18A–18F, the mandrel 82 spins, typically in a clockwise direction, to wind the band 32 into the tote assembly 10. Meanwhile, the tote assembly 10 itself is not rotating, but is held relatively stationary by the tote assembly support 80. After the desired length of band 32 has been inserted into the tote assembly 10, the band 32 must be kept still and tight while it is cut by the band cutter blade 72. Preferably, the mandrel 82 comprises a motor with a clutch that will wind faster than the niproll 66 will feed. When the niproll 66 stops feeding additional band 32 into the tote assembly 10, the mandrel thereby will hold the band 32 under tension to allow it to be cut. After the band 32 is cut, the mandrel 82 retracts and the tote assembly 10 drops to a position for removal from the winding machine 60. In the embodiment shown in FIG. 15, tote assembly 10A is ready to drop into position for band winding, tote assembly 10 is in position for band winding, and tote assembly 10B has dropped out for removal from the winding machine 60.

Preferably, the tote assembly support 80 comprises a horizontal support for additional tote assemblies to line up behind tote assembly 10A for automatic placement with the band winder 78. Similarly, the tote assembly support 80 preferably comprises a horizontal support to automatically remove tote assembly 10B after band winding.

The tote assembly 10 may be marked with indicia of its length, width, intended use, model number, or other relevant information. As shown in FIGS. 22–23, this marking is preferably performed automatically with an ink jet printer 90 onto the top, relatively flat surface of the tote assembly 10. Preferably, this printing step is performed after insertion of the band 32, although it could be done at any time.

The foregoing description of the present invention has been presented for purposes of illustration and description. The fact that the present invention has been described with reference to particular embodiments does not mean that other embodiments do not exist. It should be appreciated that many other embodiments can be provided within the spirit and scope of this invention. The embodiments described herein are further intended to explain the best mode known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A band carrying device, comprising:

a first tote assembly including:

a first tote member including a first half and a second half with said first half having a first set of mating members and said second half having a second set of mating members, said first tote member also including a first spoke having a first height and a second spoke having a second height;

a second tote member joined to said first tote member;

a band held within said first and second tote members;

a second tote assembly including:

a third tote member including at least a third spoke having a third height that is the same as said first height;

a fourth tote member including at least a fourth spoke having a fourth height that is the same as said first height; and a second band held within said third and fourth tote members.

2. A band carrying device comprising:

at least a first tote assembly including:

a first tote member including:

at least a first spoke having a first height extending inwardly of said first tote member;

a second tote member including at least a second spoke having a second height, wherein said first height of said first spoke is different from said second height of said second spoke; and a band held within said first and second tote members, wherein said first and second spokes extend inwardly and contact said band.

3. A device, as claimed in claim 1, wherein:

said first set of mating members of said first tote member includes a plurality of posts and said second set of mating members includes a plurality of receptacles and in which each of said posts is disposed in one of said receptacles for use in connecting said first tote member to said second tote member.

4. A device, as claimed in claim 1, wherein:

one of said second and third tote members includes at least one dimple and the other of said second and third tote members includes at least one hole and in which said first and second tote assemblies are stacked together using at least said one dimple and said one hole.

5. A device, as claimed in claim 1, wherein:

each of said first and second sets of mating members includes a plurality of mating members and said first tote assembly includes a window that is accessible for advancing/retracting said band, with each of said plurality of first and second mating members being spaced from said window.

6. A band carrying device comprising:

at least a first tote assembly including:

a first tote member including first spokes;

a second tote member including second spokes connected to said first tote member;

a tote center;

a container for holding parts that is held in said tote center, said container having a movable cover that allows access into said container and, when said container cover is opened, parts can be inserted into or removed from said container; and a band held within said first and second tote members.

7. A device, as claimed in claim 1, wherein:

said first tote assembly includes a flat top for receiving ink jet printing after said first and second tote members are joined together.

8. A device, as claimed in claim 1, wherein:

said first tote assembly includes an aperture for receiving a band cutting insert tool.

9. A band carrying device, comprising:

at least a first tote assembly including:

a first tote member having a periphery and a center with a substantially radial distance being defined between said periphery and said center, said first tote member including at least a first spoke having a first height, said first spoke extending for at least a majority of said substantially radial distance between said periphery and said center;

a second tote member including at least a second spoke having a second height and being joined to said first tote member; and a band held within said first and second tote members and having first and second sides opposite each other and in which said first spoke contacts said first side of said band.

10. A device, as claimed in claim 9, wherein:

said second height is different from said first height.

11. A device, as claimed in claim 9, wherein:

said first tote member includes a first half and a second half with a plurality of first mating members disposed in said first half and a plurality of second mating members disposed in said second half.

12. A device, as claimed in claim 10, wherein:

said first mating members are different from said second mating members.

13. A device, as claimed in claim 9, further including:

a container having removable cover for holding parts and in which said tote assembly includes a tote center in which said container is removably positioned.

* * * * *